US006726024B2

(12) United States Patent
Nakano et al.

(10) Patent No.: US 6,726,024 B2
(45) Date of Patent: Apr. 27, 2004

(54) APPARATUS FOR SIEVING PARTICULATE MATERIALS

(75) Inventors: Kotaro Nakano, Tokyo (JP); Kenichi Kanno, Tokyo (JP)

(73) Assignee: Tanico Corporation (JP)

( * ) Notice: Subject to any disclaimer, the term of this patent is extended or adjusted under 35 U.S.C. 154(b) by 0 days.

(21) Appl. No.: 10/146,592

(22) Filed: May 15, 2002

(65) Prior Publication Data

US 2003/0080030 A1 May 1, 2003

(30) Foreign Application Priority Data

Oct. 29, 2001 (JP) ..... 2001-330865
Nov. 26, 2001 (JP) ..... 2001-359609

(51) Int. Cl.[7] ..... B07B 1/49

(52) U.S. Cl. ..... 209/405; 209/275; 209/325; 209/365.1; 209/364

(58) Field of Search ..... 209/405, 346, 209/325, 326, 275, 276, 277, 364, 365.1, 368

(56) References Cited

U.S. PATENT DOCUMENTS 3,313,414 A * 4/1967 Gox ..... 209/236
5,265,730 A * 11/1993 Norris et al. ..... 209/326

FOREIGN PATENT DOCUMENTS

| | | |
|---|---|---|
| JP | 6-233617 | 8/1994 |
| JP | 6-233618 | 8/1994 |
| JP | 9-141205 | 6/1997 |
| JP | 10-76229 | 3/1998 |
| JP | 11-114498 | 4/1999 |
| JP | 11-128842 | 5/1999 |
| JP | 11-347492 | 12/1999 |
| JP | 2000-135474 | 5/2000 |
| JP | 2000-312860 | 11/2000 |
| JP | 2001-129483 | 5/2001 |

* cited by examiner

*Primary Examiner*—Donald P. Walsh
*Assistant Examiner*—Jonathan R Miller
(74) *Attorney, Agent, or Firm*—Scott M. Oldham of Hahn Loeser & Parks LLP

(57) ABSTRACT

A sieving device having a mesh screen detachable from a frame body is capable of easily removing particulate material remained on the mesh screen and cleaning of the mesh screen and being installed even in a confined space requiring a sanitary condition. The particulate material sieved through the mesh screen is prevented from getting out of a collecting container or scattering around. With a vibration generating means in the sieving device, sieving vibration can be efficiently produced with a relatively small power with preventing coagulation and agglomeration of the particulate material. By corrugating the bottom of the mesh screen, the efficiency of sieving the particulate material be increased remarkably.

13 Claims, 10 Drawing Sheets

APPARATUS FOR SIEVING PARTICULATE MATERIALS

BACKGROUND OF THE INVENTION

1. Field of the Invention

This invention relates to a sieving device and a sieving mesh screen, and more particularly to a sieving device capable of efficient sieving by force of vibrations generated by vibration generating means, and a sieving mesh screen easily demountably mounted in the sieving device.

2. Description of the Prior Art

Japanese Unexamined Patent Publications Nos. 2001-129483, 2000-135474, 2000-312860, HEI 11-128842, HEI 10-76229, and HEI 09-141205 disclose conventional sieving devices having mesh screens, which are vibrated by force of vibrations generated by an electromagnet, air piston, electric motor, ultrasonic vibrator or the like to sieve flour or other particulate materials.

The conventional sieving device is generally provided on its lower portion with a vibration generator, on its upper portion with a sieving receptacle having a bottom member, and with a mechanism for discharging granulated or floury particulate material sieved through the sieving receptacle. The particulate material sieved by the conventional sieving device once falls into a first collecting portion, namely, the bottom of the sieving receptacle, and moves from the first collecting portion to a second collecting portion, e g. a collecting container. Thus, the sieved particulate material agglutinates to dump while moving from the first collecting portion to the second collecting portion, consequently to diminish the purport of sieving.

Furthermore, since the sieved particulate material is discharged to the outside of the sieving device, the conventional sieving device disadvantageously necessitates a wide space for installing the collecting container or the like for receiving the sieved particulate material discharged from the device. Besides, the conventional sieving device cannot prevent the sieved particulate material from getting out of the collecting container or scattering around. Therefore, the conventional sieving device is not applicable to a kitchen with a confined space or other ambiences requiring sanitary precautions.

There has been another prior sieving device having a mechanism for removing the particulate material staying behind on a sieving screen, consequently being inevitably increased in size on the whole. Thus, this conventional sieving device requires a wide installation space and therefore is unfit to use in a confined narrow space In the conventional sieving devices noted above, vibration generated by the vibration generator mounted on the lower portion of the sieving device is transmitted to the mesh screen supported by a plurality of springs. Thus, the vibration generated by the vibration generator is not efficiently transmitted to the mesh screen due to difference in vibration transmitting routes formed by the springs. Moreover, the vibration is absorbed by the springs to decrease the efficiency of sieving and slow down the sieving speed. In order to increase the efficiency of sieving the particulate material, the size of the device including the vibration generator and power source is inevitably increased.

There has been yet another prior sieving device provided on its side portion with a vibration generator for giving lateral vibration directly to a mechanism with a mesh screen, Since the mechanism with the mesh screen in this prior device is suspended through means of a connection member and receives at one part thereof the vibration from the vibration generator in the lateral direction, the vibration is attenuated by the connection member to decrease the efficiency of sieving and slow down the sieving speed like the aforementioned prior sieving device.

Furthermore, in the aforementioned prior sieving device of large size, which is provided fixedly with the mesh screen or mechanism having the mesh screen, removal of the particulate material left on the mesh screen, cleaning of the mesh screen and installation of the sieving device cannot easily be carried out. When the particulate material left on the mesh screen is removed to clean the mesh screen, the mechanism including the mesh screen has to be detached from the device body. Even if the removal of the particulate material left on the mesh screen is easily carried out, it is difficult to clean and attach the mesh screen onto the device body.

In the sieving device provided on its side with the vibration generator for imparting the vibration directly to the mesh screen in the lateral direction, the component parts such as the mesh screen, blade member and connection member of the sieving device should be disassembled to remove the particulate material left on the mesh screen, dean the mesh screen and assemble the components parts. This turns out to be a very troublesome chore.

In addition, the prior sieving device entailed a disadvantage such that driving means including a motor and a piston inevitably generates dreadful noise and needless vibrations in operation. These undesirable vibrations could not substantially be prevented. Thus, the prior sieving device was susceptible to mechanical trouble and difficult to maintain.

In Japanese Unexamined Patent Publications Nos. HEI 11-114498, HEI 11-347492, HEI 06-233617 and HEI 06-233618, there are disclosed conventional sieving mesh screens for sieving particulate materials such as flour, which are driven to vibrate by a vibration source such as an electromagnet, motor and ultrasonic vibrator.

The prior art sieving mesh screens aim at increasing the efficiency of sieving, preventing clogging and increasing the durability. The mesh screen disclosed in Japanese Unexamined Patent Publication No. HEI 11-114498 is formed by crossing and overlapping wires each other and welding the wires so as to increase the efficiency and speed of sieving. The conventional mesh screen disclosed in Japanese Unexamined Patent Publication No. HEI 11-347492 is made by weaving compound fiber to form a rolling surface.

Also, the sieving mesh screens in other prior art are by and large made by crossing and welding wires, weaving wires or integrally molding into one body having a required number of meshes.

The prior sieving mesh screens made by crossing or weaving the wires have corrugated surfaces formed by the wires thickly overlapping each other and supported by a frame thickened by the overlapping wires. The vertical interval of the upper and lower wires of the mesh screen thus corrugated is smaller than the diameter of the wire and the thickness of the frame, so that unevenness of such a planar mesh having the vertical interval of the wires cannot Increase the number of meshes in the mesh screen of the same shape in the identical terms. Thus, there is a limit to the prior sieving mesh screen having the ragged wire surface in increasing the sieving speed and sieving efficiency. Besides, the prior sieving mesh screen requires specific materials and must be molded precisely, consequently to increase the manufacturing costs incurred and make the manufacture thereof difficult.

OBJECT OF THE INVENTION

An object of the present invention is to provide a sieving device provided with a mesh screen which can be attached and detached so as to facilitate removal of particulate material remained on the mesh screen and cleaning of the mesh screen, which sieving device is capable of preventing the particulate material while being sieved from getting out of the collecting container or scattering around, being installed even in a confined space requiring a sanitary condition, producing sieving vibration with a relatively small power source and efficiently transmitting the vibration to the mesh screen to perform sieving of particulate material at a high speed with high efficiency, preventing coagulation and agglomeration of particulate material, and suppressing noises generated by itself.

Another object of the present invention is to provide a sieving device having a mesh screen capable of eliminating the shortcomings of the mesh screen disposed in a conventional sieving device, and increasing the speed and efficiency of sieving particulate material.

Still another object of the present invention is to provide a sieving device having a high-efficiency mesh screen, which can easily be manufactured at a lower cost.

SUMMARY OF THE INVENTION

To attain the objects described above according to the present invention, there is provided a sieving device comprising a frame body, a feeding unit mounted on the upper portion of the frame body for feeding particulate material vibration generating means mounted on the middle portion of the frame body for imparting vibration to a pair of vibration members, a mesh screen detachably attached to the vibration members, and a reception unit mounted on the lower portion of the frame body for receiving the particulate material.

The aforementioned sieving device can prevent the particulate material while being sieved from getting out of the collecting container or scattering around, and be used even in a confined space requiring a sanitary condition. In the sieving device, the vibration generated by the vibration generating means can be transmitted to the mesh screen with high efficiency at a high speed so as to carry out effective sieving of the particulate material, and further prevent coagulation and agglomeration of the particulate material.

The paired vibration members are fixedly connected with each other through a joining member. This structure brings about the synergistic effect of the vibration members and joining member, so that the effective vibration can be obtained with a small vibration source and efficiently transmitted to the whole of the mesh screen, thereby to carry out sieving of the particulate material quickly with high efficiency.

The vibration members each have a concave portion in the respective opposite surfaces, so that both ends of the mesh screen can be removably fitted thereinto. With this structure, the mesh screen can easily be dismounted for cleaning up.

In another embodiment of the invention, the vibration member comprises a base body supported by a support member, vibration transmitting members projecting from the base body, and joining member secured on the tip ends of the vibration transmitting members, and the aforementioned frame body is provided in both side portions of the middle portion thereof with a hollow portion having inner holes so as to contain the vibration generating means and vibration members in the hollow portion. The vibration transmitting members protrude through the inner holes in the hollow portion so as to secure the mesh screen onto the joining member on the vibration transmitting members protruding through the inner holes. This sieving device makes it possible to prevent the sieved particulate material from getting out of the collecting container or scattering around, consequently to facilitate cleaning and maintenance of the device, In this sieving device, the vibration generating means may be formed of an electromagnetic means, and the vibration member Is supported by a flexible support member having vibration members to be attracted to the electromagnetic means. This mechanism can suppress noises generated in sieving operation and facilitates cleaning and maintenance of the sieving device.

The vibration generating means and support member may be mounted on a mount frame placed on vibration absorbing means. According to this mechanism, noises and undesired vibrations generated in operating the sieving device can be suppressed.

On the frame body, a moving member may be placed for carrying the reception unit in a vertically movable state.

The sieving device may further comprise a press plate supported by the frame body in such a state that one end of the moving member is engaged with the tip end of the press plate.

Further, the sieving device may be provided with a lock mechanism for securing the press plate in position, so that the reception unit can easily be mounted on the frame body and the distance between the mesh screen and the reception unit can be reduced. Consequently, this mechanism makes it possible to prevent scattering, coagulation and agglomeration of the sieved particulate material.

The mesh screen may be formed of a bottom member having a rugged surface and a side member. The bottom member of the mesh screen may be formed in a corrugated shape. The corrugated screen mesh may be formed in the shape of a quadrangular pyramid.

By forming the mesh screen in various shapes as described, the bottom surface of the mesh screen can be increased in area, thus the number of meshes. Therefore, the particulate material being sieved is brought in sufficient contact with the mesh screen without modifying the configuration of the mesh screen, so that the particulate material can be prevented from agglutinating or gathering in clusters. Furthermore, the sieving of the particulate material can be efficiently carried out at a high speed with high screening power. By using the corrugated mesh screen, the sieving efficiency can be more increased. The mesh screen in the sieving device of the invention can readily be manufactured from any sort of material without using specific material, the manufacturing cost for producing the sieving device of the invention can be decreased.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Figure 1:
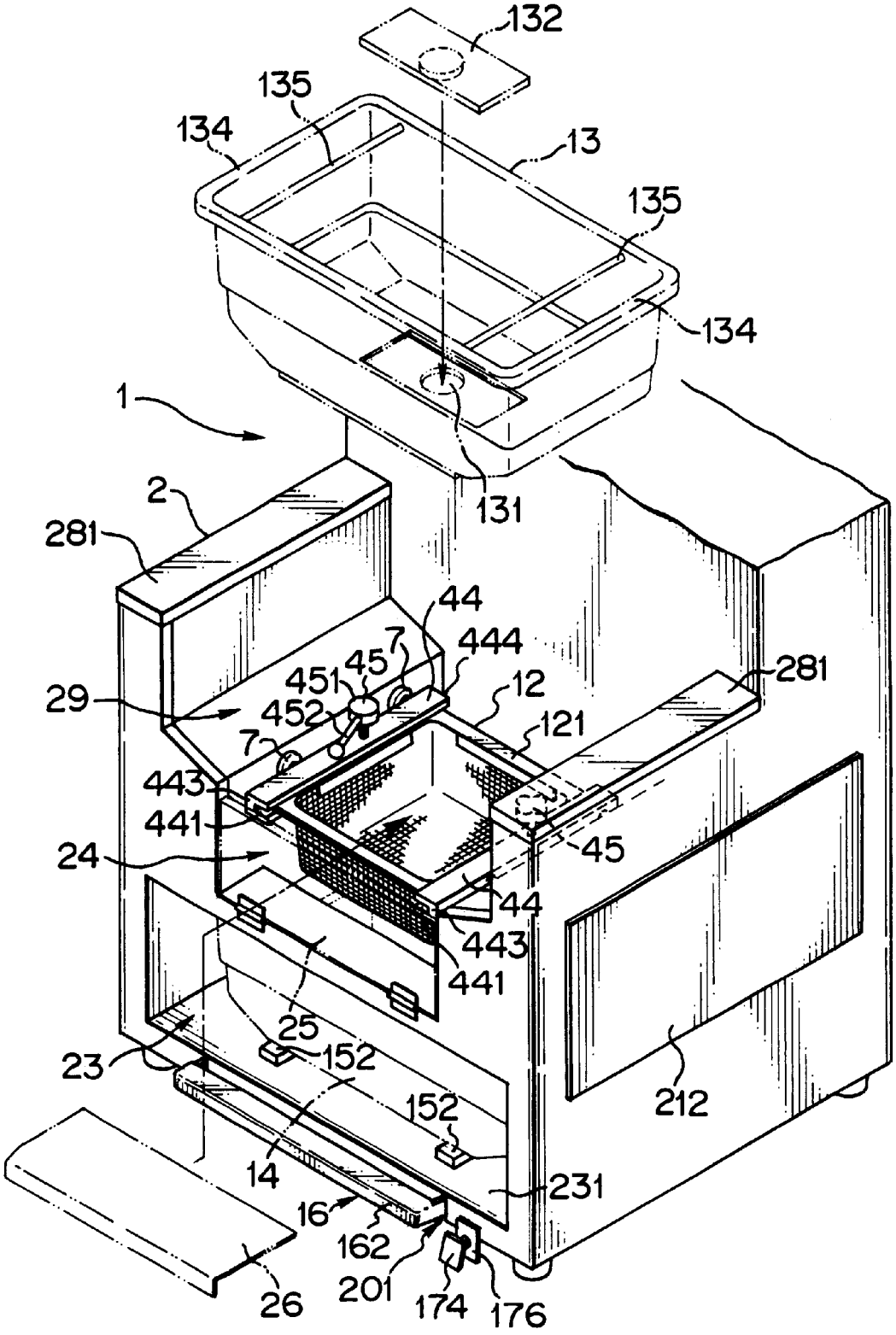
FIG. 1 is an exploded perspective view showing one embodiment of the sieving device according to this invention.
Figure 2:
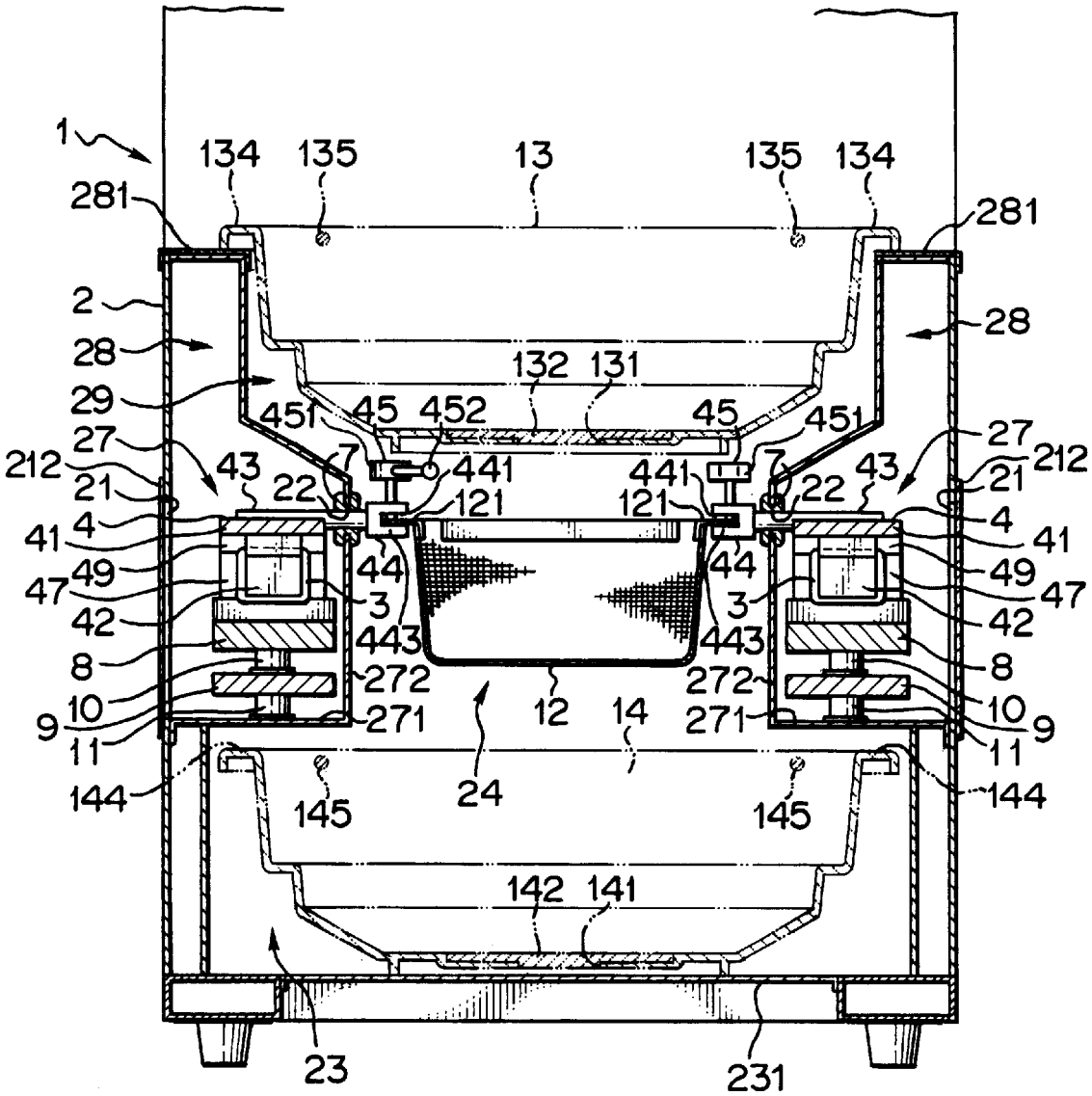
FIG. 2 is a sectional view showing another embodiment of the sieving device according to this invention.
Figure 3:
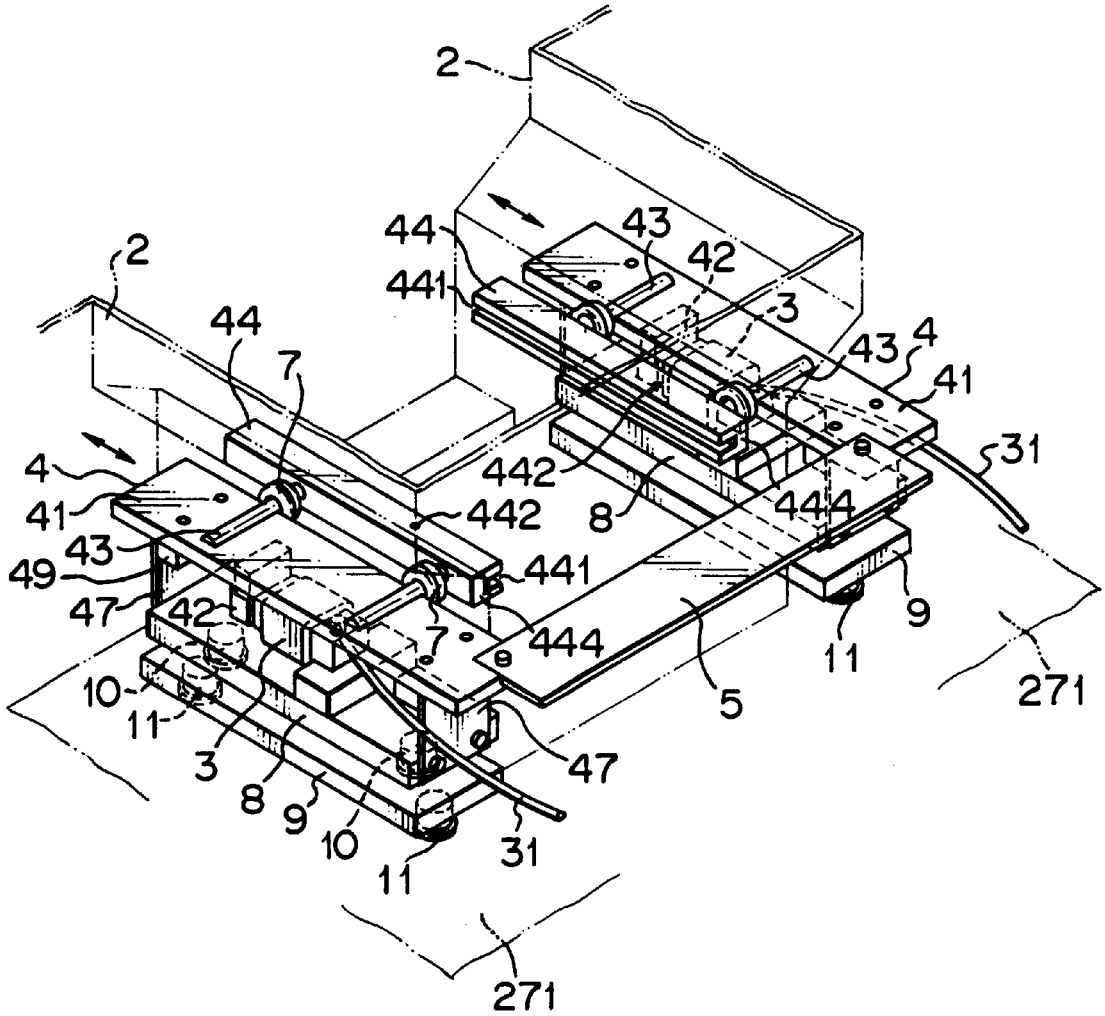
FIG. 3 is a perspective view showing a hollow portion in the sieving device of FIG. 1.
Figure 4:
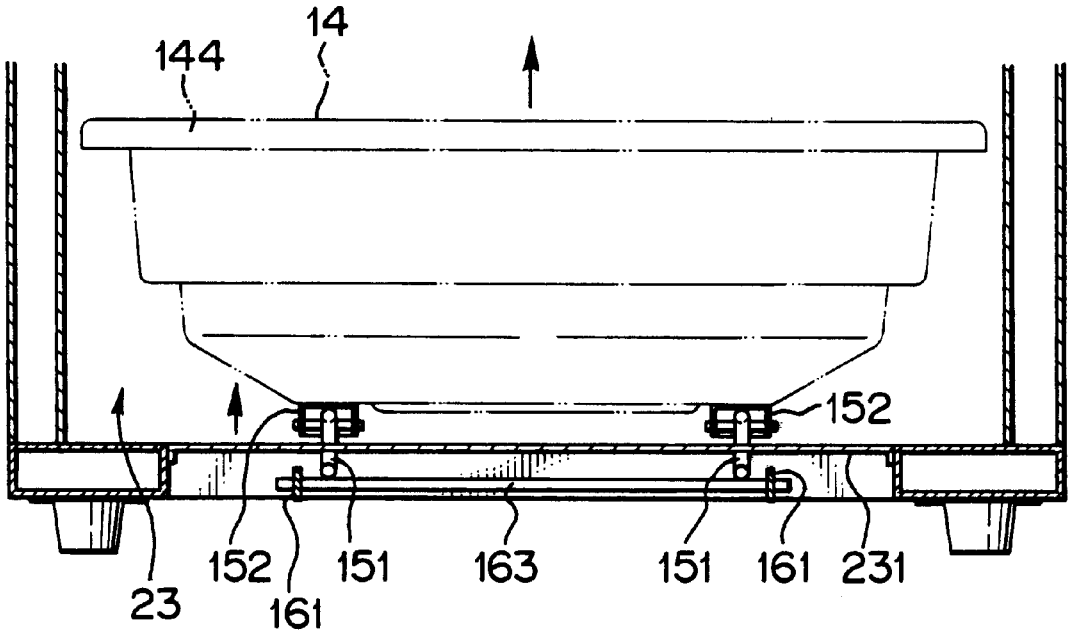
FIG. 4 is a sectional view showing a lower portion in the sieving device of FIG. 1.
Figure 5:
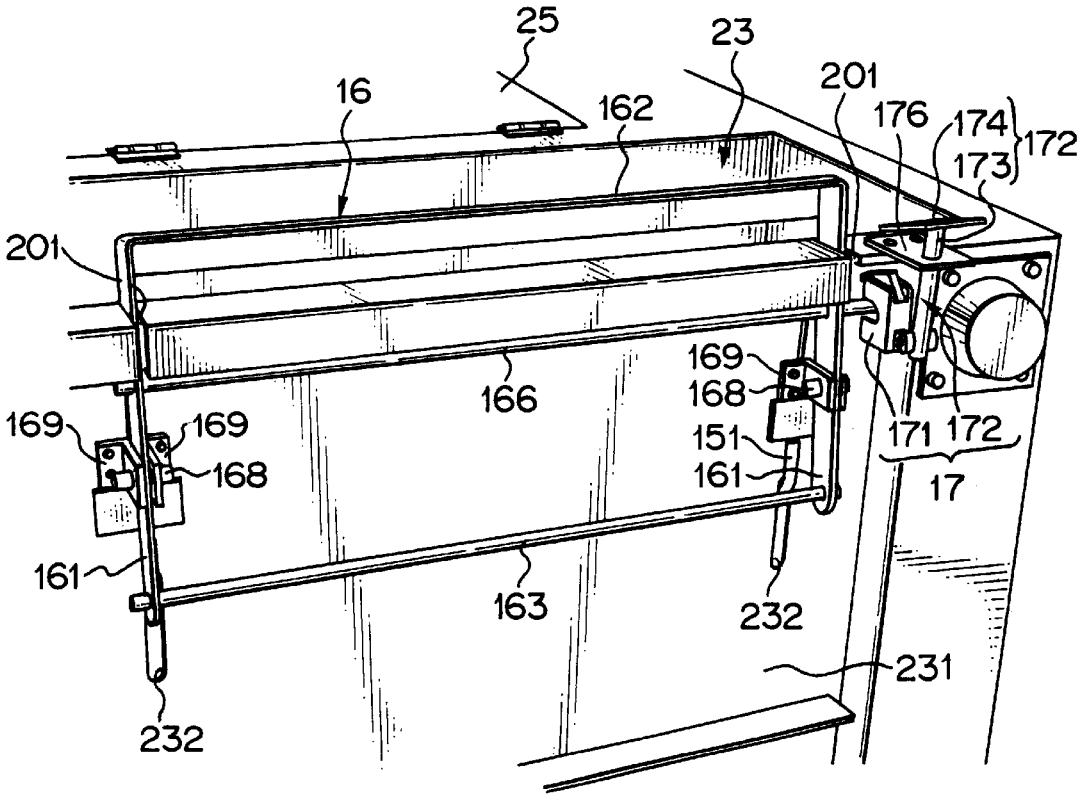
FIG. 5 is a partial perspective view showing the sieving device of FIG. 1 viewed from the bottom.
Figure 6:
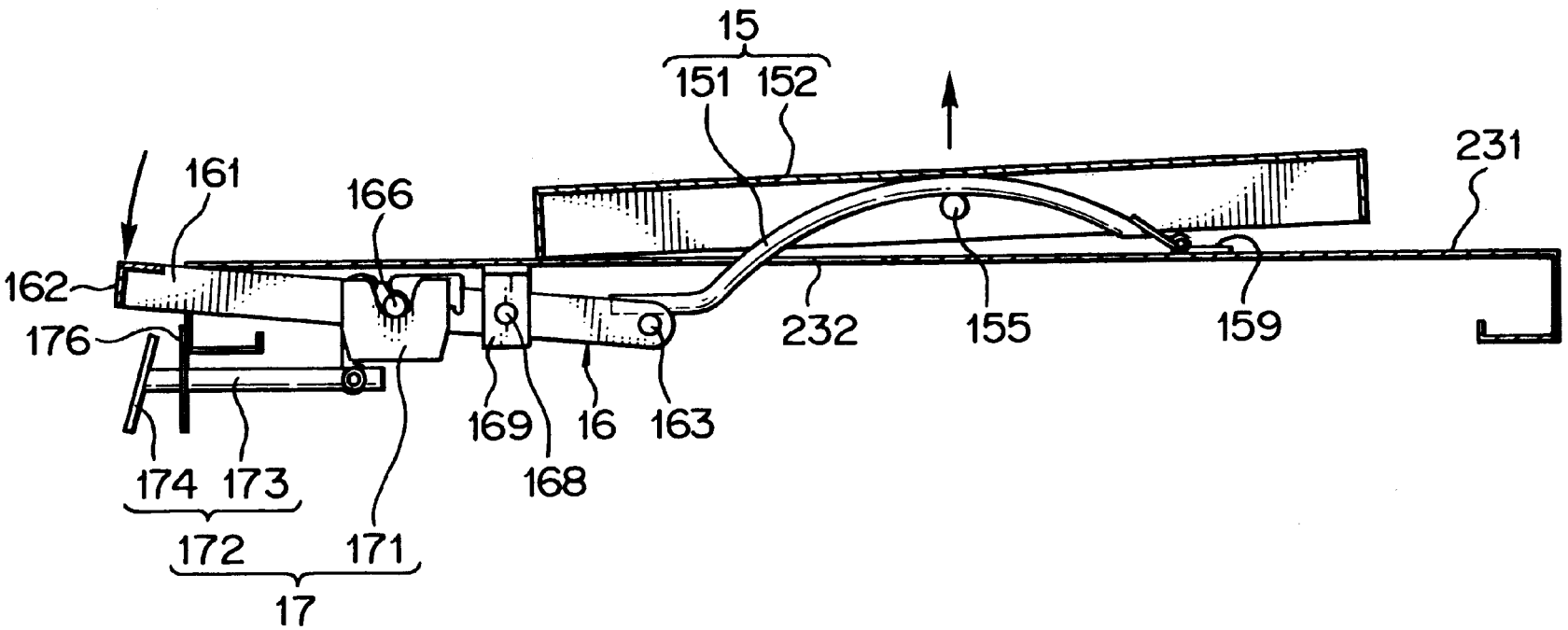
FIG. 6 is a sectional view showing elevating means of a reception unit in the sieving device of FIG. 1.

The sieving device according to the present invention will be described hereinafter with reference to the accompanying drawings. The sieving device 1 comprises a frame body 2, vibration generating means 3, vibration members 4, a joining member 5, a mount frame 8, vibration absorbing means 10, and a mesh screen 12. On the upper portion of the sieving device 1, a feeding container 13 serving as a feeding unit is mounted, and the lower portion of the sieving device is provided with collecting container 14 serving as a reception unit.

With the frame body 2, the vibration generating means 3, vibration members 4, joining member 5, mount frame 8, vibration absorbing means 10 and mesh screen 12 are covered and secured, and the containers 13 and 14 are supported. The frame body 2 is made of stainless steel. The bottom member extending inwardly from either side of the middle portion of the frame body 2 has hollow portions 27 in which the vibration generating means 3, vibration members 4, mount frame 8, and vibration absorbing means 10 are mounted. In the inner surfaces 272 within the hollow portions 27 of the frame body 2, holes 22 for allowing the vibration members 4 to project therethrough are bored. The shape and number of the holes are adequately determined in accordance with the shape and number of the vibration members 4 and vibration transmitting members 43.

In both outer side surfaces of the hollow portions 27 of the sieving device 1, there are formed side windows 21. It is desirable to mount openable window covers 212. Through the side windows 21, the vibration generating means 3, vibration members 4, mount frame 8, and vibration absorbing means 10 mounted on the fame body 2 in the hollow portions can easily be observed and preserved.

Under the frame body 2, there is mounted a reception unit holding portion 23 for demountably receiving the collecting container 14. Above the reception unit holding portion 23, a sieve holding portion 24 into which the mesh screen 12 placed between the hollow portions 27 is inserted. The sieve holding portion 24 has an opening of a size larger than the vertical section of the mesh screen 12 so as to allow the mesh screen 12 to slide into the sieve holding portion from the front of the sieving device 1 It is desirable to attach an openable door 25 to the front portion of the sieve holding portion 24 and mount a lid cover 26 on the top of the sieve holding portion 24. The lid cover 26 should be so designed as not to hinder feeding of the particulate material into the feeding container 13 through the opening formed in the top of the sieve holding portion 24. Also, it is desirable to cover the front of the reception unit holding portion 23 with an openable lid.

In both side portions on the top of the frame body 2, upper spaces 28 continuous with the hollow portions 27 are formed. The inner surface 272 of the frame body 2 is inclined over the extent from the hollow portion 27 to the upper space 28. Above the sieve holding portion 24, a feeding unit holding portion 29 for accommodating the feeding container 13 serving as the feeding unit for the particulate material is formed on the top of the sieving device 1. On the upper surface portion of the upper space, the end portion of the feeding container 13 is placed to form rest portions 281 each having adequate width. Further, in the rear surface of the middle portion of the frame body 2, there is a space for connecting the hollow portions 27 with each other, so that the joining member 5 is placed therein and fixedly connected to the vibration members 4.

Thus, the feeding container 13 serving as the feeding unit for feeding particulate material and the collecting container 14 serving as the reception unit for receiving the particulate material sieved through the mesh screen are steadily held within the feeding unit holding portion 29 and the reception unit holding portion 23, respectively That is, the containers 13 and 14 are embraced on three sides the side surfaces of the holding portions 23 and 29, and substantially enclosed on all sides by the front door 26 and lid 26 in addition to the side surfaces of the holding portions 23 and 29. Also, the vibration generating means 3, vibration members 4, joining member 5, mount frame 8, and vibration absorbing means 10 are fully covered within the hollow portions 27 and the space formed in the middle rear portion of the frame body 2, apart from the feeding container 13 serving as the feeding unit, the collecting container 14 serving as the reception unit, mesh screen 12, feeding unit holding portion 29, reception unit holding portion 23, and sieve holding portion 24. With this structure as described, the sieved particulate material can be prevented from scattering around and sticking to the vibration generating means 3, vibration members 4, joining member 5, mount frame 8, and vibration absorbing means 10, thus to facilitate cleaning and maintenance of the sieving device.

Each vibration generating means 3 for making the mesh screen 12 vibrate is an electromagnet which is activated with electric current fed through a lead wire 31 and controlled by a circuitry operated with a switch button (not shown). The two vibration generating means 3 are disposed one on either side of the hollow portions 27. The pair of vibration generating means 3 may be actuated synchronously or independently, Incidentally, although the vibration generating means 3 in this embodiment is formed of the electromagnet as described, the vibration generating means in the invention may not necessarily be limited to an electromagnet, but it may of course be formed of a motor, hydraulic piston or other vibrating means. In the case where the motor is used in place of the electromagnet, a vibration transmission mechanism including a cam or the like may be used for transmitting vibration from the vibration source to the vibration members. The vibration generating means 3 are integrally secured onto the rear surface of the middle portion of the frame body 2 so as to impart the vibration to the vibration members 4 through the joining member 5, thus to vibrate the mesh screen.

The vibration member 4 vibrates with the vibration generated by the vibration generating means 3 and imparts its own vibration to the mesh screen 12. The vibration member 4 is composed of a base body 41, a passive vibration member 42, a vibration transmitting member 43, and a connection member 44. The base body 41 is formed like a flat plate or rod having adequate length and arranged horizontally parallel to the sieve holding portion so as to have one end thereof located within the rear space of the sieving device 1. The vibration members 4 are placed on the support members 47 retained on their front and rear ends of the mount frame 8 by use of bolts or the like. Each support member 47 is formed of a thin plate of stainless steel or the like, which is capable of vibrating and has sufficient strength for supporting the vibration member 4. It is a matter of course that the support member 47 may be formed in the shape of a rod or column or other shape or molded from synthetic resin, as and when it has sufficient strength for placing the vibration members 4 thereon so as to efficiently vibrate the vibration members 4 backwards and forwards.

It is desirable to fix the base body 41 on the support members 47. Although the base body 41 may be fixed on the support members 47 by using bolts or welding, it is recommendable to use clamp members 49 fixed on the base body 41 by bolting or welding to fix the base body 41 on the support members. The clamp members 49 exerted by a return force of the curved support members 47 cause the vibration members 4 to vibrate and the vibration generating means 3 to separate from the electromagnets. Each clamp member 49 is formed like a quadratic prism extending along the longitudinal side of the base body 41 and serves a function of preventing the base body 41 from vibrating exceedingly.

The passive vibration member 42 functions to transmit the vibration generated by the vibration generating means 3 to the base body 41, and is made of iron or the like, which has adequate thickness and is magnetically attracted by the electromagnet serving as the vibration generating means 3. The passive vibration member 42 is fixed on the lower surface of the base body 41 by welding, bolting or other fixing measures so as to be placed within a magnetic field of the electromagnet being activated and separated at a distance from the electromagnet when no exciting current is applied to the electromagnet serving as the vibration generating means 3. Furthermore. It is recommendable that the passive vibration member 42 be arranged so as not to come in contact with the electromagnet even when the electromagnet is excited with exciting current to electromagnetically attract the passive vibration member, and the support member 47 provides strength against bending stress.

Each vibration transmitting member 43 for transmitting the vibration from the base body 41 to the mesh screen 12 through the connection member 44 is formed in a plate, column or other desired shape, preferably a cylindrical shape, and fixed on the base body 41 by welding, bolting or other fixing measures, passing through the hole 22 formed in the inner side 272 of the frame body 2. It is desirable to provide two or more vibration transmitting members 43 for one base body 41. It is a matter of course that the vibration transmitting member 43 may be formed in not only a column shape, but also a flat plate shape, and one or more vibration transmitting members may be used. It is further desirable to attach a hollow elastic packing seal 7 of rubber or synthetic resin to the periphery of the hose 22 in the frame body 2, so as to prevent the frame body 2 from coming into collision with the vibration transmitting member 43 without hindering the vibration of the vibration transmitting member 43, and prevent intrusion of the particulate material into the hollow portion 27.

Incidentally, it is optional to place the connection member 44 on the base body 41 or mount the mesh screen 12 directly on the base body 41 without using the vibration transmitting member 43.

The connection members 44 for placing the mesh screen 12 in position and joining the vibration members 4 to the mesh screen 12 are supported by the vibration transmitting members 43. The connection member 44 is formed of synthetic resin, stainless steel or the like in a column shape having a squarish U shaped section with a longitudinal groove 441, The column-like connection member 44 thus formed is so arranged that the groove 441 horizontally extends from the front side of the frame body 2 toward the rear side thereof along the sieve holding portion 24. Although the longitudinal groove 441 starts from the front end of the connection member 44, but does not necessarily extend to the rear surface 444 of the connection member 44 so as to prevent the mesh screen 12 from excessively moving rearward, thus to allow the mesh screen 12 to come to an appropriate stop in position.

Thus, insertion of the mesh screen 12 into the sieving device is fulfilled by sliding the longitudinal edges 121 of the mesh screen 12 along the longitudinal grooves 441 in the connection members 44. However, the structure of retaining the mesh screen 12 is not specifically limited to the illustrated embodiment. It is optional to make the connection member 44 of a material having moderate flexibility or attach a sheet having a moderate flexibility to the lower surface or upper surface of the groove 441, so as to bring the connection member 44 in fit contact with the groove 441 through the flexible material or sheet. As an alternative, the mesh screen 12 is securely retained by turning screws 45 each having a screw knob 451 through screw holes 442 bored in each connection member 44 so as to firmly press down the edge 121 of the mesh screen 12 against the lower surface of the groove 441. It is desirable to provide the screw knob 451 with a rod-shaped handle 452 extending horizontally.

The joining member 5 for joining the vibration members 4 is formed of a plate-like or rod-like rigid member. With the joining member 5, the vibration members 4 are integrally joined with each other within the space for connecting the hollow portions 27 enclosed by the frame body 2 on the rear side of the middle of the sieving device 1. The connection of the joining member 5 and the vibration members 4 is fulfilled with use of bolts and nuts, but the joining member 5 and the vibration members 4 may be connected by welding, The vibration generating means 3 and support members 47 are placed on the mount frame 8.

Under the bottoms 271 of the hollow portions 27, there are disposed a plurality of vibration absorbing means 10 for supporting the mount frame 8 so as to absorb the vibration occurring on the mount frame 8 due to the vibration generated by the vibration generating means 3, thus preventing the sieving device 1 from vibrating in an undesirable manner. The vibration absorbing means 10 may be made of a spring, elastic synthetic resin, a spring coated with elastic synthetic resin, or the like.

Further, it is desirable to have another mount frame 9 and vibration absorbing means 11 placed between the vibration absorbing means 10 and the bottom 271 of the hollow portion 27 in the frame body 2, so that the mount frames 8 and 9 and vibration absorbing means 10 and 11 are superposed one above another, respectively. With this mechanism, the vibration generated by the vibration generating means 3 can be absorbed more effectively, thus preventing the sieving device 1 from vibrating in an undesirable manner.

The mesh screen 12 is formed of quadrilaterally rising mesh sides having mesh size according to the grain size of the particulate material to be sieved, consequently to form a basket-like container having a substantially square upper brim 121. The length of the brim 121 extending in the depth direction is much the same as that of the groove 441 extending in the depth direction of the connection member 44, and the thickness of the brim 121 is equal to or smaller than that of the groove 441. The mesh screen 12 may be formed like a semicircular basket having a round upper brim, or a rectangular parallelepiped basket having an oblong upper brim. Even in these cases, the length and thickness the brim 121 extending in the depth direction must be determined on the same footing as above.

The mesh screen 12 is formed of the rising sides, i.e. side member 122 and the bottom member 123. Although the side member 122 and bottom member 123 of the mesh screen in this embodiment are made of stainless steel, they may be made of synthetic resin, metal or any other materials. It is preferable to make the mesh screen of stainless steel of SUS304 rather than SUS430, which is more tarnishable than SUS304. Of course, the sides 122 and the bottom 123 of the mesh screen 12 may be made of different materials, In the illustrated embodiment, the side member 122 and bottom member 123 of the mesh screen 12 are produced separately and integrally united by welding or depositing. However, the mesh screen 12 may be made of different materials in a composite manner, namely, it can be molded by integral molding. It is recommendable to cover the upper peripheral brim of the mesh screen with a protective member 1222 of the same material as that of the sides of the mesh screen or other material so as to ensure safety and facilitate washing of the mesh screen. By way of example, the mesh screen may be produced by folding a flat net plate of stainless steel SUS304 into concertinas to form a net bottom and firmly joining the net bottom to the edge of the side member by spot-welding. When the protective member 1222 is not formed, the upper peripheral portion of the side member of the mesh screen may be turned down.

The side member 122 and the bottom member 123 of the mesh screen 12 may be produced in several, and then, joined with each other into one body by fitting the bottom member 123 into the side member 122 and bolting them. Alternatively, the side member 122 may be formed of net material, frame and beam member, and the bottom member 123, which is made flat or corrugated, may be united to the frame and/or beam member of the side member 122. In this case, the side member may be flat or corrugated.

Although only the bottom member may be made of net material it is more effective to make the side member and bottom member of net material than to make only the bottom member of net material In order to increase the sieving speed and efficiency. The shape, arrangement, pitch and size of the meshes of the mesh screen 12 are not specifically limited, and should be determined in accordance of the aspect and grain size of the particulate material to be sieved.

The side member 122 of the mesh screen 12 is made of flat stainless steel so as to be formed like a hollow square column having desired height. Instead, the side member 122 may be formed in a hollow cylindrical shape or any other shape. The side member 122 as well as the bottom member 123 may be ragged or corrugated. The side member 122 of the mesh screen may be made of flat mesh material or by weaving or bonding wires of stainless steel or synthetic resin into a sheet-like mesh net. In a case of making the side member 122 of a sheet or plate of stainless steel or synthetic resin, a number of mesh holes may be bored in the side member 122 later on.

Although the bottom member 123 may be made flat, it is preferable to corrugate the bottom member 123. That is, the bottom member 123 made flat at first may be bent, curved, ragged or corrugated finally. In this case, the ragged or corrugated mesh net implies a not-flat plane exclusive of concavities and convexities formed by the woven wires and beam members constituting the mesh screen, The ragged or corrugated plane of the mesh net may be formed so as to have the vertexes of different heights, or convexities shaped in a circular cone, pyramid, polygonal pyramid, hemisphere, semicircular column, or lie-down semicircular column. In the case of the corrugated mesh bottom, the fine connecting the vertexes of the convexities of the ragged mesh net is generally parallel with the line connecting the bases of the concavities, but these lines may not necessarily be parallel therewith. Also, the lines connecting the vertexes of the convexities and connecting the bases of the concavities of the ragged mesh net may extend straight or be curved.

It is desirable to make the top fines of convexities of the corrugated mesh bottom obtuse so as to easily carrying out cleaning of the mesh screen in safety. The height of each of the vertexes of the convexities of the ragged mesh bottom is not specifically limited, but it is better to make the height of the convexity lower than the height of the side member 122.

The bottom member 123 may be made by punching a flat stainless steel plate to bore mesh holes therein and then corrugating the stainless steel plate, thus to obtain the desired corrugated mesh screen 124. As an alternative, the mesh screen 124 may be produced by weaving wires of stainless steel or synthetic resin capable of maintaining the shape thereof to form a mesh sheet, and finally corrugating the mesh sheet, or molding synthetic resin into a corrugated mesh screen with an injection molding die. In a case of using a mesh side member 122, it can be produced in the same manner as the production of the mesh bottom member 123 as mentioned above.

The mesh screen 12 has a flange-like brim 121 extending outwardly on the upper part of the side member 122. The outwardly extending brim 121 is useful for hooking the mesh screen 12 on the sieving device in sieving the particulate material or holding the mesh screen 12 by hand. The brim 121 may be made in the form of a brim 1211 extending along the entire upper edge of the side member 122, or on the two opposed upper edges 1212 of the side member 122, or on two parts 1213 opposed to each other on the upper edge of the side member 122, respectively. As an alternative, the brim 121 projecting outward horizontally may be formed one on either opposite sides of the upper edge of the side member 122, like a pair of grips.

The brim 121 is attached to the upper edge of the side member 122 or a coating member 1222 stuck to the upper edge of the side member by using bolts and nuts or welding. It is a matter of course that the coating member 1222 may be bent at right angles or replicated so as to be stuck to the inner surface of the upper edge of the side member 122 to form the brim 121. The brim 121 should be designed in conformity with the conditions of the sieving device or other components with the mesh screen 12, but it may not necessarily be required in a case of employing the other supporting means for retaining the sieving device or manually holding the mesh screen.

Figure 7:
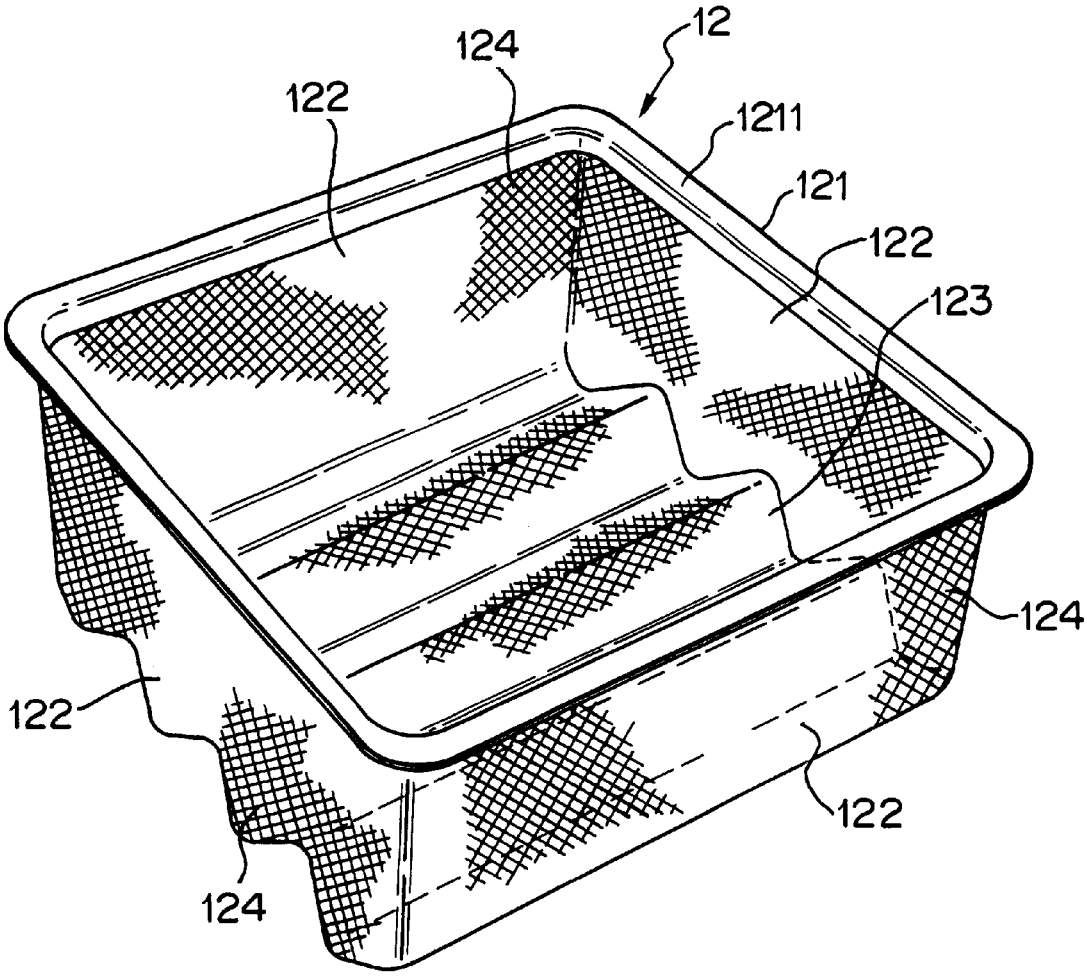
FIG. 7 is a perspective view showing a mesh screen in the sieving device of FIG. 1.

The mesh screen 12 shown in FIG. 7 is formed of the side member 122 and bottom member 123, which are obtained by weaving stainless steel wires into nets. The side member 122 has a substantially square cross-section and curved corners.

The bottom member 123 is formed into a wave shape having wave vertexes of the same height and wave bottoms of the same depth. To be specific, the corrugated bottom member 123 is designed so as to make the line connecting the wave vertexes thereof parallel to the line connecting the wave bottoms, and the convexities of the corrugated bottom orthogonal to the opposite surfaces of the side member 122. The direction in which the mesh screen formed of the corrugated bottom and side member is not specifically limited. That is, the mesh screen 12 may vibrate in the direction parallel or orthogonal to the line connecting the wave vertexes of the convexities of the corrugated bottom member or in a circular motion.

Figure 8:
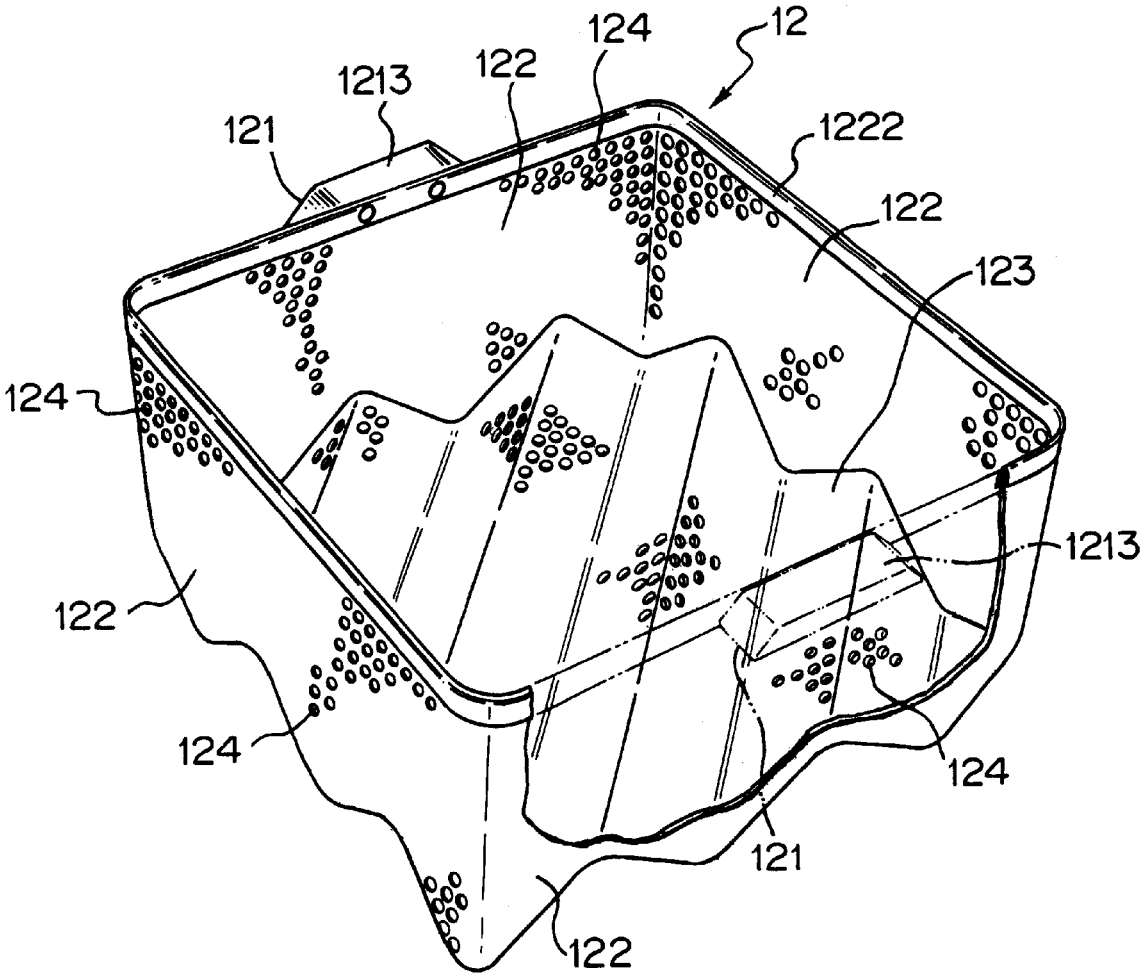
FIG. 8 is a partially sectioned view showing the mesh screen in the sieving device of FIG. 1.

The mesh screen 12 shown in FIG. 8 has the side member 122 and bottom member 123 both made of stainless steel plates with mesh holes 124. The side member 122 has a substantially square cross-section and curved corners. The bottom member 123 is corrugated so as to make the line connecting the wave vertexes thereof parallel to the line connecting the wave bottoms, and the convexities of the corrugated bottom meeting the side member 122 at the angle of 45 degrees.

Although the side member 122 in this embodiment has a substantially square cross-section and curved corners and the bottom member 123 is corrugated so as to make the line connecting the wave vertexes thereof parallel to the line connecting the wave bottoms, the convexities of the corrugated bottom may be designed so as to meet the side member 122 at the other angles than the right angles and 45 degrees.

The mesh screens 12 in the embodiments shown in FIG. 7 and FIG. 8 each have four wave vertexes and five wave bottoms. Namely, in these embodiments, the slopes of the corrugated bottom member 123 placed at the corners of the side member 122 are each terminated without a wave vertex. Furthermore, the wave vertexes and wave bottoms of the corrugated bottom member in the illustrated embodiments have the same curvature, the curvature of them may of course vary to increase or decrease the number of the waves of the corrugated bottom member.

Figure 9:
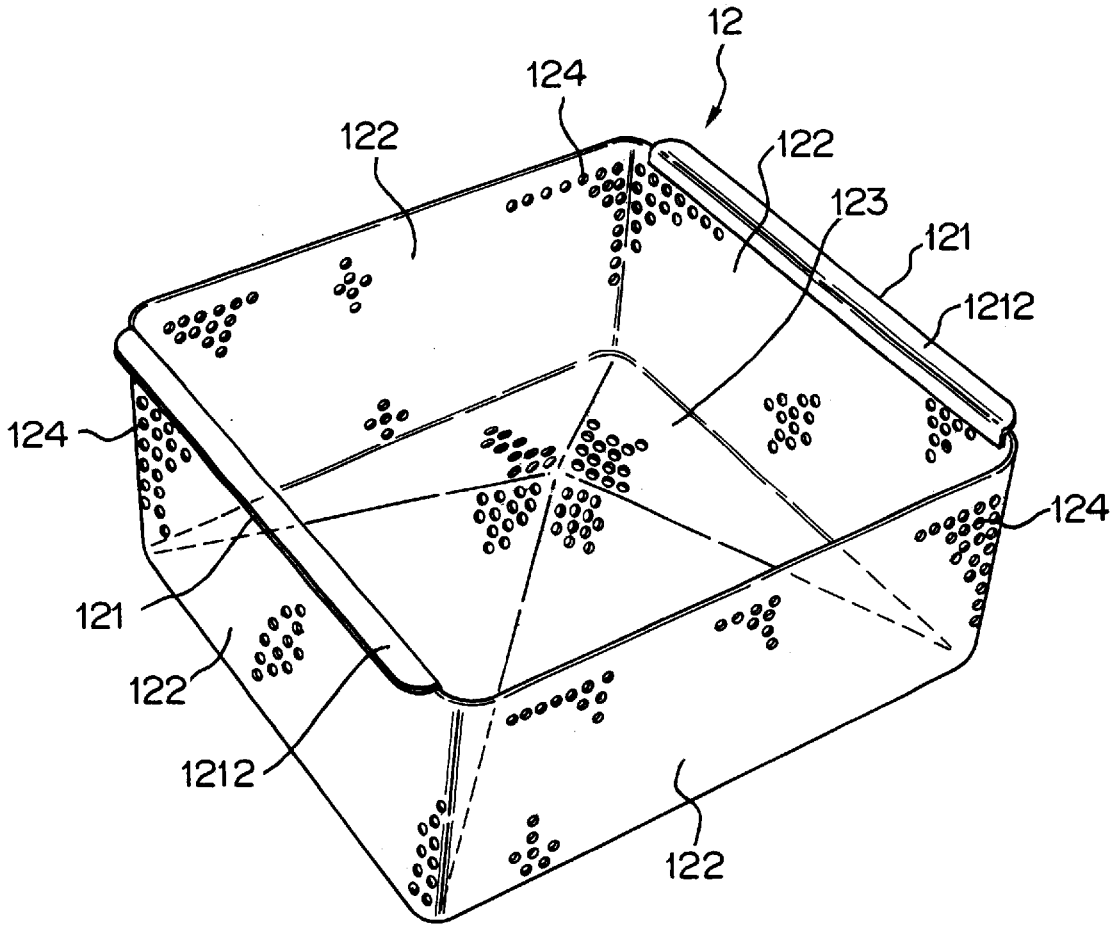
FIG. 9 is a perspective view showing a mesh screen in still another embodiment of the sieving device of the invention.

The mesh screen 12 shown in FIG. 9 has the side member 122 and bottom member 123 both made of stainless steel plates with mesh holes 124. The side member 122 has a substantially square cross-section and curved corners. The bottom member 123 is formed in the shape of a quadrangular pyramid composed of four isosceles triangles. The four lower sides of the quadrangular pyramid bottom member 123 are in connection with the lower edge of the side member 122. Although the bottom member 123 in this embodiment is shaped in a quadrangular pyramid, the shape of the bottom member is not specifically limited to the quadrangular pyramid and may be formed in the shape of any other polygonal pyramid. Each side slope of the quadrangular pyramid bottom member 123 may not necessarily be shaped in an isosceles triangle or may respectively have different shapes. Also, the lower sides of the pyramid of the bottom member 123 may not necessarily be joined to the lower edge of the side member 122, but may be designed to meet any portion of the side member 122.

The bottom member 123 may be upraised in part. That is, the concavities and convexities have not necessarily to be formed over the entire surface of the bottom member 123, so that the area other than the concavities and convexities may be made flat.

The bottom member 123 may be provided with one or more protrusions of a circular cone, quadrangular pyramid, other polygonal pyramid, or hemisphere shapes.

Figure 10:
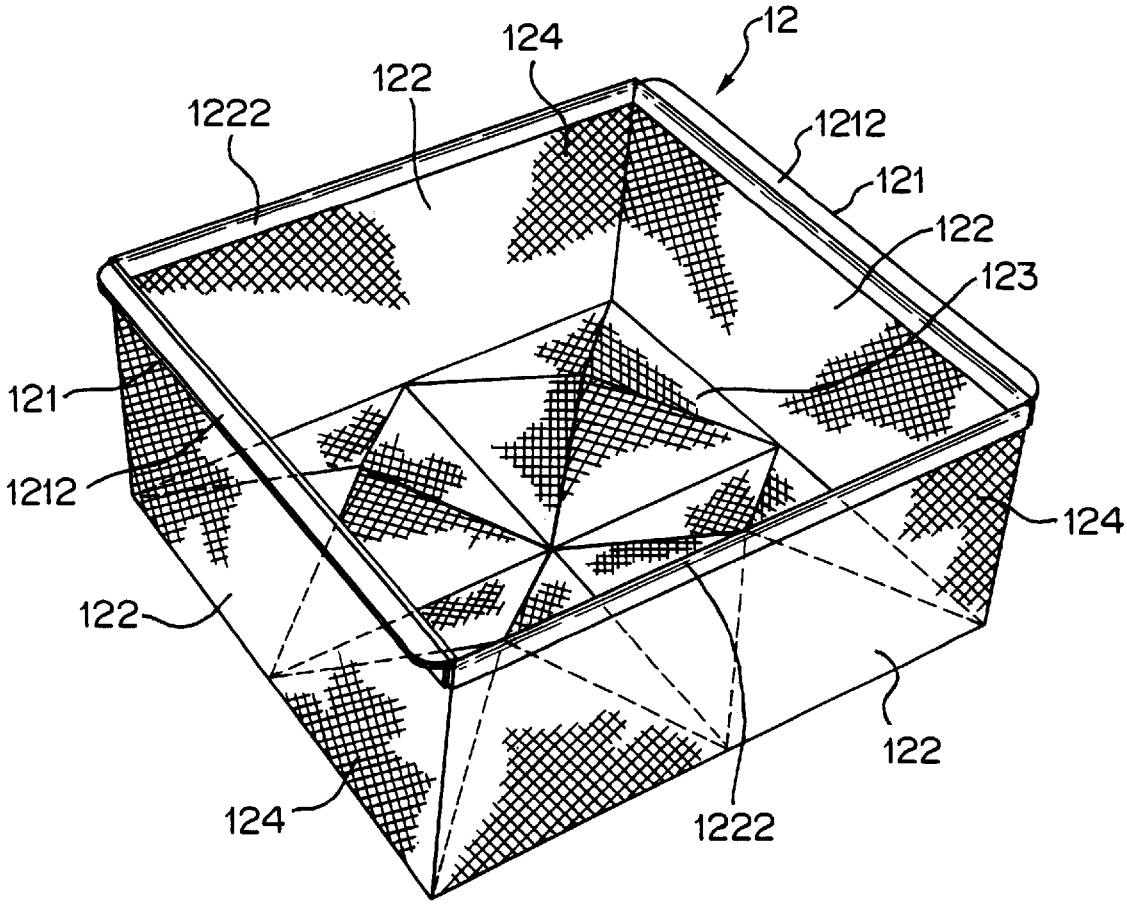
FIG. 10 is a perspective view showing a mesh screen in yet another embodiment of the sieving device of the invention.

The mesh screen 12 shown in FIG. 10 has the side member 122 and bottom member 123 both formed by weaving stainless steel wires. The side member 122 has a substantially square cross-section and curved corners. The bottom member 123 has four protrusions each shaped in a quadrangular pyramid. However, the number of the quadrangular pyramid protrusions is not specifically limited to four. Also, the shape and size of the protrusions on the bottom member 123 is not specifically limited, and may be freely determined.

Although the protrusions on the bottom member 123 may be formed protruding upward into the shape of a circular cone, pyramid, polygonal pyramid, hemisphere, semicircular column, or lie-down semicircular column as illustrated, they may protrude downward or upwardly and downwardly by turn.

A practical experiment on the sieving speed of sieving particulate material was performed by using the sieving device 1 having the bottom member 123 with protrusions different in shape according to the present Invention. As the particulate material to be sieved, 15 kg of flour was used. In the experiment, the time required for sieving out and completely passing the particulate material through the mesh screen was measured. The sieving device 1 used in the experiment comprises the side member 122 shaped in a rectangle having four sides each of 282 mm and the height of 149 mm from the bottom to the upper end of the side member. The side member 122 and bottom member 123 of the mesh screen 12 used in the experiment are each made of a plate of stainless steel SUS304 of 1.0 mm thickness. In the side member 122 and bottom member 123 have round holes arranged in lines longitudinally and in zigzag transversally at regular intervals,

COMPARATIVE EXAMPLE

There was used a mesh screen having a flat bottom member with mesh holes of 3 mm diameter arranged at intervals of 4 mm.

Embodiment 1

There was used a mesh screen having a corrugated bottom member 123 with concavities and convexities arranged in parallel to one another and orthogonal to the opposed surfaces of a side member 122 according to the invention. The bottom member 123 used in the experiment are 35 mm in thickness corresponding to the vertical interval from the vertex of the convexity to the bottom of the concavity. Each slope of the concavities and convexities is 86 degree in tilt angle. The vertex of the convexity and the bottom of the concavity each have a curvature of R10. The mesh holes are 3 mm in diameter and 4 mm in pitch. In the experiment, vibration was imparted to the mesh screen 12 orthogonally to the lengthwise direction of the convexities of the corrugated bottom member 123.

Embodiment 2

There was used a mesh screen having a corrugated bottom member 123 with concavities and convexities arranged in parallel to one another and orthogonal to the opposed surfaces of a side member 122 according to the invention. The bottom member 123 used in the experiment are 35 mm in thickness corresponding to the vertical interval from the vertex of the convexity to the bottom of the concavity. Each slope of the concavities and convexities is 86 degree in tilt angle. The vertex of the convexity and the bottom of the concavity each have a curvature of R10. The mesh holes are 2 mm in diameter and 3 mm in pitch. In the experiment, vibration was imparted to the mesh screen 12 orthogonally to the lengthwise direction of the convexities of the corrugated bottom member 123.

Embodiment 3

There was used a mesh screen having a corrugated bottom member 123 with concavities and convexities arranged in parallel to one another and orthogonal to the opposed surfaces of a side member 122 according to the invention. The bottom member 123 used in the experiment are 35 mm in thickness corresponding to the vertical interval from the vertex of the convexity to the bottom of the concavity. Each slope of the concavities and convexities is 86 degree in tilt angle. The vertex of the convexity and the bottom of the concavity each have a curvature of R10. The mesh holes are 2 mm in diameter and 3 mm in pitch. In the experiment, vibration was imparted to the mesh screen 12 parallel to the lengthwise direction of the convexities of the corrugated bottom member 123.

Embodiment 4

There was used a mesh screen comprising a side member and a bottom member 123 having a base flash with the lower edges of side surfaces 2 of the side member. The bottom member 123 used in this experiment is shaped in a quadrangular pyramid having four isosceles triangular sides and a height of 100 mm. The mesh holes are 2 mm in diameter and 3 mm in pitch.

Embodiment 5

There was used a mesh screen having a corrugated bottom member 123 with concavities and convexities having the line connecting the vertexes of the convexities arranged in parallel to the line connecting the bottoms of the concavities according to the invention. The vertexes of the convexities of the corrugated bottom member 123 are arranged obliquely at 45 degrees relative to the side member 122. The bottom member 123 used in the experiment are 35 mm in thickness corresponding to the vertical interval from the vertex of the convexity to the bottom of the concavity. Each slope of the concavities and convexities is 86 degree in tilt angle. The vertex of the convexity and the bottom of the concavity each have a curvature of R10. The mesh holes are 2 mm in diameter and 3 mm in pitch.

Embodiment 6

There was used a mesh screen having a corrugated bottom member 123 with concavities and convexities having the line connecting the vertexes of the convexities arranged in parallel to the line connecting the bottoms of the concavities according to the invention. The vertexes of the convexities of the corrugated bottom member 123 are arranged obliquely at 45 degrees relative to the side member 122. The bottom member 123 used in the experiment are 35 mm in thickness corresponding to the vertical interval from the vertex of the convexity to the bottom of the concavity. Each slope of the concavities and convexities is 86 degree in tilt angle. The vertex of the convexity and the bottom of the concavity each have a curvature of R10. The mesh holes are 2 mm in diameter and 3 mm in pitch. The corners defined between the side surfaces 2 have a curvature of R20.

The experimental results are shown in Table 1 below.

TABLE 1

| Comparative Example 1 | 2 min. 1 sec. |
|---|---|
| Embodiment 1 | 30 sec. |
| Embodiment 2 | 1 min. 8 sec. |
| Embodiment 3 | 30 sec. |
| Embodiment 4 | 40 sec. |
| Embodiment 5 | 43 sec. |
| Embodiment 6 | 43 sec. |

As shown in Table 1 above, according to the sieving device of Embodiment 1 of the invention, the time required for sieving the prescribed quantity of particulate material could be reduced to approximately one-fourth relative to Comparative Example 1. Although Embodiments 1, 2 and 6 are different in that the mesh holes 124 are 3 mm in diameter and 4 mm in pitch in Embodiment 1 and the mesh holes 124 are 2 mm in diameter and 3 mm in pitch in Embodiments 2 and 6, the time required for sieving the particulate material in Embodiment 2 is about twice as long as Embodiment 1. This means that if the mesh holes 124 in Embodiments 3 and 6 are made identical with those in Embodiment 1 or Comparative Example 1, the required time for sieving may possibly be reduced to about half. In any case, it is evident from the results of the experiment that the mesh screen having the corrugated bottom member 123 can achieve remarkably high speed and efficiency of sieving particulate material in comparison with the conventional mesh screen with the flat mesh bottom.

It can be assumed that such an immeasurable effect brought about by the sieving device according to the invention is attributed to enlargement of the bottom member 123 of the mesh screen 12, consequently increasing the number of mesh holes 124 and allowing the particulate material even in clumps to come in efficient contact with mesh screen. That is, the effective area of the mesh screen can be increased by corrugating the bottom member, thus to increase the efficiency of dispersing and disparting the particulate material and make it possible to break even masses of particulate material to fine particles, The mesh screen 12 having the corrugated bottom member with the concavities and convexities as described above can be applied to not only the sieving device according to the invention, but also to a variety of common sieving devices different in shape and/or structure such as a manual sieving device for home use and a large size sieving device for business purpose.

Although the mesh screen 12 for dealing with the particulate material such as flour is described by way of example, it can of course be applied for sieving earth, sand, grit, gravel or other particles and grains by adequately changing the mesh size of the mesh screen 12 and/or modifying the components such as the side member 122 and bottom member 123 in the sieving device of the invention. Alternatively, by reducing the components of the mesh screen 12, various minute particles can be dealt with by the sieving device of the invention, The container 13 serves as a feeding unit for storing and supplying the particulate material contained therein. The container 14 serves as a collecting unit for receiving the particulate material sieved through the mesh screen 12. The container 13 and container 14 in the illustrated embodiment are conveniently identical with each other in shape so as to be interchangeable with each other. The containers 13 and 14 have bottoms with holes 131 and 141 in the bottoms thereof respectively. For making provisions for using either of the containers 13 and 14 as the feeding unit, the container is provided along its upper peripheral edge with a flange member 134 or 141 for placing the container on the rest positions 281 of the frame body 2. When the container 13 or 14 containing the particulate material is delivered, the hole 131 or 141 is covered with a lid 132 or 142 made of rubber, synthetic resin or the like. When the container is used as the feeding unit for feeding the particulate material, the rest portions 281 disposed on the upper surfaces of the frame body 2 are provided with flange members 134. When the container is used as the reception unit for receiving the particulate material sieved through the mesh screen, it is placed within the reception unit holding portion 23 in such a state that the hole 141 is covered with the lid 142. The flanges 134 and 144 may be formed only on parts of the upper portions the containers 13 and 14, which are opposite to the rest portions 281. It is desirable to form rod- or tongue-shaped grips 135 and 145 on appropriate positions of the containers 13 and 14 for easy carrying.

The feeding and reception units employed in the invention are not limited only to the feeding and collecting containers 13 and 14 as illustrated In the drawings. In place of the feeding container 13, a belt conveyer, hopper or other feeding means may be used as the feeding unit for feeding the particulate material onto the mesh screen 12. Also, instead of the collecting container 14, a belt conveyer, bag or other collecting means may be used as the reception unit for receiving the particulate material sieved through the mesh screen 12.

It is desirable to mount means for elevating the reception unit in the sieving device of the invention. By using the elevating means, the inner height of the reception unit holding portion 23 can be made sufficiently larger than that of the container 14. Thus, the collecting container 14 can easily be inserted into the extensive reception unit holding portion 23 while providing sufficient room under the mesh screen 12, and then, the collecting container 14 placed within the reception unit holding portion 23 is lifted up until coming in contact with the mesh screen 12, consequently to enable the collecting container to reliably collect the particulate material sieved through the mesh screen 12 without scattering the particulate material about. The elevating means in this embodiment is composed of moving members 15, a press plate 16 and a lock mechanism 17.

The moving members 15 each comprise a support rack 152 on which the container 14 is mounted, and support rods 151. The support rod 151 is formed in a rod or plate of a portion curved in a semicircle and a straight portion. The support rods 151 are inserted through two oblong holes 232 and have their one end attached in the vertically rotatable state to the positions on the bottom 231 of the frame body 2 on the extension line from the oblong holes 232 with hinges 159. The support rack 152 is shaped in a rectangular box having four sides and upper side surface so as to surround the support rods 151 with the upper and side surfaces thereof. The support rack 152 is joined with the support rods 151 in the vicinity of the apexes of the support rods by welding or other joining measures. In order to obtain firm connection between the support rods 151 and the support rack 152, the support rods 151 may preferably be fixated by a supplementary member 155 fixedly arranged on the support rack 152 orthogonal to the support rods 151. The supplementary member 155 may be brought into the lower surfaces the support rods 151 or pierce the support rods crosswise and firmly retained to the support rods 151 by welding or other joining measure.

The support rack 152 is not specifically limited to the rectangular box shape, may of course be formed in a flat, semicircle or triangular pyramid shape. That is, the support rack 152 may be made of an orthogonal box capable of enclosing the support rods 151 or a flat panel capable of retaining the support rods. It is desirable to form the support rack 152 having a shape and size capable of sufficiently covering the oblong holes 232. In order to facilitating inserting and removing of the container 14 relative to the reception unit holding portion 23, the support rack 152 united with the support rods 151 is so disposed as to assume its horizontal posture when the moving members 15 reach their uppermost position and incline up toward the rear of the sieving device 1 when the moving members 15 reach their lowermost position.

The press plate 16 serves to elevate the moving members 15. The press plate 16 is made of a substantially rectangular plate or rod member having side parts 161, front part 162 and rear part 163. The side parts 161 and front part 162 are formed in a squarish U shape. The side parts 161 each have a hole at their front ends, through which the rear part 163 is inserted. It is desirable to form the front part 162 with the upper end part having an adequate width, preferably 5 cm to 10 cm. The press plate 16 is disposed so as to have the side parts 161 parallel to the side members of the frame body 2, and front and rear parts 162 and 163 parallel to the front and rear members of the frame body 2. The front part 162 extends out of the front member of the frame body 2. Therefore, the frame body 2 is provided in its front lower portion with notches 201 for receiving the side parts 161 of the press plate 16. The press plate 16 is rotatably retained on the frame body 2 by inserting pivot pins 168 through holes bored in the middle portions of the side parts 161 and holes bored in pivot members 169 fixed onto the lower surface of the bottom 231 of the frame body 2. On the rear part 163, the straight end portions of the support rods 151, which are free from the frame body 2, are placed.

The lock mechanism 17 for holding the press plate 16 in a desired position comprises a lock member 171 and a release lever 172. The lock member 171 has a lock slot for catching a lock rod 166 extending laterally from the side parts 161 of the press plate 16. When the lock rod 166 enters into the lock slot in the lock member 171, the lock member 171 clamps the lock rod 166 in the immovable state. The lock rod 166 clamped by the lock member 17 is released by operating the release lever 172. However, the lock mechanism 17 in the sieving device is not specifically limited to the structure described herein. Although only one lock mechanism 17 mounted In the vicinity of the outer side part 161 of the press plate 16 disposed on the lower surface portion of the bottom 231 of the frame body 2 suffices for the sieving device of the invention, a pair of lock mechanisms may be disposed one on either portion in the vicinity of the respective outer side parts 161 of the press plate 16. In order to stably clamp the press plate 16, it is desirable to have the lock rod 166 penetrate through both the side parts 161 of the press plate 16 as illustrated. The release lever 172 is formed by attaching a pedal 174 extending outward over the front of the frame body 2 to the upper end of a release stem 173. For guiding the release lever 172, a support plate 176 through which the release stem 173 pierces is fixed onto the frame body 2.

The elevating means includes the moving members formed in a rod, plate or box shape, which are supported by the frame body 2, so that the collecting container 14 is retained and moved up and down by the front ends of the moving members passing through the reception unit holding portion. Each moving member is supported on the frame body 2 by inserting a pivot pin through a hole formed in the moving member and a hole formed in the side member of the frame body. Around the pivot pin serving as the fulcrum, the moving member is rotatably moved up and down. The elevating means may be provided with an anti-kickback gear for preventing counter-rotation of the moving member.

The moving members 15 in the foregoing embodiment Is retained at their ascent position when the press plate 16 is locked by the lock mechanism 17 and comes down to their descent position when the press plate is released. As an alternative, the elevating mechanism may be so designed that the moving members 15 may be permitted to take their ascent position under normal conditions and move downward when the collecting container 14 is set into the sieving device. In this case, the moving members 15 may be supported elastically from beneath and linked with the press plate 16 through a cam and so on, so as to be moved downward the moving members 15 by pressing down the front part 16 of the press plate 16. The moving members 15 may be directly connected with press plate 16 so as to be moved downward by pushing upward the front part 162 of the press plate 16 to move down the support rods 151 engaged with the rear part 163.

There may of course be disposed a driving source such as a motor for elevating the moving members 15, so that the moving members 15 can be automatically moved up and down in conjunction with the driving source through the means of a cam or the like.

Next, the usage and operation of the sieving device 1 according to the invention will be described. First, the empty collecting container 14 is set into the reception unit holding portion 23. To be more specific, the container 14 Is placed on the support racks 152 and forced downward by stepping the front part 162 of the press plate 16 or other pressing measures. By pressing down the front part 162 of the press plate, the press plate 16 is rotated around the pivot pin 168 to move the rear part 163 upward. As the rear part 163 moves upward, the support rod 151 and support rack 152 are moved upward rotatably around the hinges 159 together with the moving members 15. Consequently, the collecting container 14 put on the moving members 15 is lifted up to approach the mesh screen 12. At this time, the lock rod 166 is firmly held by the lock member 171 to position the container 14 in its ascend standby position.

Next, the feeding container 13 containing particulate material to be sieved is set on the feeding unit holding portion 29 in such a manner that the flanges 134 of the container 13 are placed on the rest portions of the frame body 2. Then, the mesh screen 12 is retained within the connection member 44 by sliding the brims 121 of the mesh screen 12 into the grooves 441 in the connection member 44 from the front. Since the mesh screen 12 can be inserted into the frame body from the front, the insertion of the mesh screen into the frame body may of course be performed before setting the feeding container 13 onto the frame body 2.

Thereafter, the power system for the vibration generating means 3 is switched on to intermittently excite the electromagnets of the vibration generating means 3 continuously. The intermittent electromagnetic forces generated by intermittently exciting the electromagnets magnetically attract the vibration transmitting members 42 periodically. At the moment of activating the electromagnets, the clamp members 49 of each of the vibration members 4 exert the support members 47, consequently to bend the support members 47. Inversely, at the moment of deactivating the electromagnets, the support members 47 elastically returns to push back the clamp members 49, consequently pulling the vibration transmitting members 42 apart from the vibration generating means 3 and bringing the vibration members 4 back to their initial positions. As a result, such continuous reciprocating motions of the vibration members 4 cause the mesh screen 12 to vibrate through the medium of the vibration transmitting members 42 and connection member 44.

Since the vibration members 4 are connected to the joining member 5, the efficiency of generating the vibration can be interactively enhanced, but the vibration generated by the vibration generating means is little transmitted to the sieving device 1 owing to the vibration absorbing means 10 and 11 and the elastic packing seal 7.

When the mesh screen 12 starts to vibrate, the lid 132 is removed from the feeding container 13 containing the particulate material, to cause the particulate material to spontaneously fall into the collecting container 14 through the mesh screen 12.

Upon completely sieving the particulate material into the collecting container 14, the sieving device is switched off to deactivate the vibration generating means 3, consequently to stop vibrating of the mesh screen. Then, as the pedal 174 is pushed down toward the sieving device 1 to press down the release lever of the lock mechanism 17, the lock member 171 is released, thus moving down the moving members 15. Consequently, the collecting container 14 can be separated from the mesh screen 12 and removed from the sieving device.

Although the aforementioned sieving device 1 is used for sieving the particulate material such as flour by way of example, the sieving device of the invention can be applied for sieving earth, sand, grit, gravel or other particles and grains by adequately changing the mesh size or other conditions of the mesh screen 12.

As is apparent from the foregoing description, since the sieving device according to the present invention comprises a frame body, a feeding unit for feeding particulate material, vibration generating means mounted on the frame body for imparting vibration to vibration members, a mesh screen detachably attached to the vibration members and a reception unit mounted on the frame body for receiving the particulate material, the particulate material can be efficiently sieved without getting out of the collecting container or scattering around. The sieving device of the invention can be used even in a confined space requiring a sanitary condition. According to the invention, the vibration generated by the vibration generating means can be transmitted to the mesh screen with high efficiency at a high speed so as to carry out effective sieving of the particulate material, and further prevent coagulation and agglomeration of the particulate material.

Since the paired vibration members are fixedly connected with each other through a joining member, the synergistic effect of the vibration members and joining member can be brought about, so that the effective vibration can be obtained with a small vibration source and efficiently transmitted to the whole of the mesh screen, thereby to carry out sieving of the particulate material quickly with high efficiency.

Furthermore, the vibration members each have a concave portion in the respective opposed surfaces, so that both ends of the mesh screen can be removably fitted thereinto, thereby to facilitate removable of the mesh screen, and therefore, the mesh screen can easily be cleaned up, Thus, the present invention can materialize the sieving device with the mesh screen, which can be attached and detached so as to facilitate removal of particulate material remained on the mesh screen and cleaning of the mesh screen. The sieving device of the invention can prevent the particulate material while being sieved from getting out of the collecting container or scattering around, produce sieving vibration with a relatively small power source, and efficiently transmit the vibration to the mesh screen to perform sieving of particulate material at a high speed with high efficiency, while suppressing noises generated by itself. Besides, the sieving device having a high-efficiency mesh screen can easily be manufactured at a lower cost.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A sieving device comprising a frame body having an upper portion, a middle portion and a lower portion, a feeding unit mounted on said upper portion of said frame body for feeding particulate material, a vibration generating system mounted on said middle portion of said frame body for imparting vibration to a pair of vibration members, a mesh screen detachably attached to said vibration members, and a selectively removable reception unit mounted in said lower portion of said frame body for receiving and storing the particulate material that has been sieved, wherein said reception unit is mounted to be vertically moveable within said frame body and moving members are mounted on said frame body, and said reception unit is placed on said moving members.

2. The sieving device set forth in claim 1, wherein said vibration members are fixedly connected with each other through a joining member.

3. The sieving device set forth in claim 1, wherein said vibration members each have a mounting section having a mounting groove, wherein a portion of said mesh screen is in said mounting groove.

4. The sieving device set forth in claim 3, wherein said vibration member comprises a base body supported by a support member, vibration transmitting members having tip ends and projecting from said base body, and a joining member secured on said tip ends of said vibration transmitting members, and said frame body having side portions, wherein side portions of said middle portion of said frame body provide an area within said frame body to accommodate said vibration generating means and vibration members.

5. The sieving device set forth in claim 4 wherein said vibration generating system and said support member are mounted on a mount frame placed on vibration absorbing means.

6. The sieving device set forth in claim 1 wherein said vibration generating system is formed of an electromagnetic means, and said vibration member is supported by a flexible support member having vibration members to be attracted to said electromagnetic means.

7. The sieving device set forth in claim 6, wherein said vibration generating system and support member are mounted on a mount frame placed on vibration absorbing means.

8. The sieving device set forth in claim 1, further comprising a press plate rotatably supported by said frame body and engaged with said moving members.

9. The sieving device set forth in claim 8, further comprising a lock mechanism for securing the press plate in position.

10. The sieving device set forth in claim 1 wherein said mesh screen comprises at least a bottom member having a corrugated surface.

11. The sieving device set forth in claim 10, wherein said bottom member of said mesh screen is formed in waves.

12. The sieving device set forth in claim 11, wherein said side member of said mesh screen is formed in a rectangular shape, said waves of said corrugated bottom member being arranged obliquely at 45 degrees relative to said side members.

13. The sieving device set forth in claim 1, wherein said mesh screen comprises a bottom member formed in at least one quadrangular pyramid shape.

* * * * *